US009418803B2

(12) United States Patent
Huang et al.

(10) Patent No.: US 9,418,803 B2
(45) Date of Patent: Aug. 16, 2016

(54) INERTIA SWITCH

(71) Applicant: National Tsing Hua University, Hsinchu (TW)

(72) Inventors: Yu-Che Huang, Yilan (TW); Chang-Yi Liu, Taoyuan (TW); Wei-Leun Fang, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 412 days.

(21) Appl. No.: 13/906,385

(22) Filed: May 31, 2013

(65) Prior Publication Data

US 2014/0216913 A1 Aug. 7, 2014

(30) Foreign Application Priority Data

Feb. 4, 2013 (TW) ..... 102104275 A

(51) Int. Cl.
*H01H 29/00* (2006.01)

(52) U.S. Cl.
CPC ..... *H01H 29/002* (2013.01)

(58) Field of Classification Search
CPC ..... H01H 29/002
USPC ..... 200/61.47, 600
See application file for complete search history.

(56) References Cited

U.S. PATENT DOCUMENTS 3,895,197 A * 7/1975 Mizrahi ..... F21S 48/212 200/184
3,973,092 A * 8/1976 Breed ..... H01H 29/08 200/186
4,158,118 A * 6/1979 Graf ..... H01H 59/0009 137/251.1
4,528,851 A * 7/1985 Ozols ..... H01H 29/002 200/61.46
4,920,330 A * 4/1990 Plozner ..... B60Q 1/302 200/61.45 R
5,751,074 A * 5/1998 Prior ..... H01H 29/002 200/190

* cited by examiner

*Primary Examiner* — John Chapman, Jr.
(74) *Attorney, Agent, or Firm* — Birch, Stewart, Kolasch & Birch, LLP

(57) ABSTRACT

An inertia switch includes a stack of a base plate and a base cover. The base plate provided inside a liquid storage chamber and a sensing chamber communicating with a liquid storage chamber. The liquid storage chamber contains working fluid, and the sensing chamber equipped with a sensing electrode extending to and connected to an external equipment that tend to interact with the inertia switch. The electricity-conductive liquid is utilized as a medium for inertia detection. Furthermore, by the width, depth and angle of the flow channel design, when the liquid material flows into the sensing chamber through the channel after a time delay, a sensing signal is obtained by the sensing electrodes through a change of a resistance value or a capacitance value to actuate the switch. The inertia switch has a simple structure and is low cost.

9 Claims, 6 Drawing Sheets

INERTIA SWITCH

BACKGROUND OF THE INVENTION

1. Field of the Invention

The invention relates to a switch and, more particularly, to an inertia switch which can be automatically actuated under an inertia impact.

2. Description of the Related Art

An inertia switch is a precision inertia device which performs switch mechanical action when inertia acceleration is sensed. It can automatically act and be connected to relating equipment under an inertia impact to perform relating operations. Recently, the inertia switch is used widely, such as an inertia protection switch in the automobile field. When a car has a collision or a severe impact, the inertia protection switch acts and actuates relating equipment to cut off the power supplied to a petrol pump, and then an engine is forced to be off. Consequently, the accident loss and the possibility of a fire are reduced, and it can protect the car.

Currently, the widely-used inertia switch has a mechanical assembly structure, and it is rather large and heavy. Furthermore, it includes many gears, slide blocks, springs and the like, it needs huge amount of manpower, much time, many equipment and high cost, which is rather expensive.

BRIEF SUMMARY OF THE INVENTION

One objective of the invention is providing an inertia switch with simple processing and structure, and low cost.

As a result, an inertia switch is provided, it includes a stack of a base plate and a cover plate, the inertia switch includes a liquid storage chamber, a sensing chamber, and channels communicating therebetween. The working fluid is sealed in the liquid storage chamber, the sensing chamber includes a sensing electrode extending outside the inertia switch.

In an embodiment, the liquid storage chamber and the sensing chamber are communicated via the channels, and the width of the channel is between 500 to 1000 micrometers.

In an embodiment, the width of the channel is 750 micrometers.

In an embodiment, the depth of the channel is 250 micrometers.

In an embodiment, the liquid storage chamber and the sensing chamber are communicated via the channels, a connection open angle between the channel and the sensing chamber is 30 to 90 degrees.

In an embodiment, the connection open angle between the channel and the sensing chamber is 60 degrees.

In an embodiment, the liquid storage chamber and the sensing chamber are connected to a pressure regulation chamber via at least two air channels, respectively.

In an embodiment, the working fluid is a liquid metal.

In an embodiment, the liquid metal is Galinstan, mercury, or Na—K alloy.

In an embodiment, the working fluid is a non-conductive liquid such as Glycerin, water, polyethylene glycol, or sodium dodecyl sulfate (SDS).

Furthermore, a method for producing the inertia switch is also provided, it includes the following steps: (1) producing the base plate and forming a liquid storage chamber, a sensing chamber, and channels communicating the liquid storage chamber and the sensing chamber at the base plate; (2) producing the cover plate and producing a sensing electrode at a position of the cover plate corresponding to the sensing chamber; (3) quantitatively dripping the working fluid into the liquid storage chamber of the base plate; and (4) overlaying the cover plate on the base plate and packaging the base plate and the cover plate.

In an embodiment, the liquid storage chamber, the sensing chamber, and channels communicating therebetween are formed by the silicon wafer etching means, including but limited to, in the micro-electromechanical process. The micro-electromechanical process has the advantages that it can select the mature semiconductor process and contract manufacturers to manufacture components, and the cost can be reduced and the yield of the components are improved due to the mass production. Additionally, the micro-electro-mechanical processing technology has developed local heating and packaging mechanism, it can achieve wafer-level package, and it has advantages of anti-dirty, antioxidation, longer service life, and better package protection.

In an embodiment, the sensing metal electrode is produced via the physical vapor deposition (PVD) and the photolithography process, and a polymer zone is defined via the polymer deposition system and the photolithography and Oxygen plasma etching means, so as to obtain a hydrophilic zone (the metal electrode part) and a hydrophobic zone (the polymer part), respectively.

In an embodiment, a quantitative dispensing system is used to drip the liquid material.

In an embodiment, the base plate and the cover plate are packaged via the micro-electromechanical wafer bonding process.

To solve the above problem, the actuation method of an inertia switch includes the following steps: (1) making the working fluid in the liquid storage chamber of the inertia switch flow into the sensing chamber; (2) actuating the external equipment connected to the inertia switch via a sensing signal when the sensing electrode senses that the working fluid flows into the sensing chamber and sends the sensing signal.

In an embodiment, the working fluid is a liquid metal. The sensing electrode senses that the working fluid flows into the sensing chamber via the sensing a resistance change or capacitance change. The working fluid is a non-conductive liquid. The sensing electrode senses that the non-conductive liquid flows into the sensing chamber via the capacitance change.

In an embodiment, the liquid metal is Galinstan, mercury, or Na—K alloy.

In an embodiment, the working fluid is a nonmetal liquid such as Glycerin, water, polyethylene glycol or SDS. The sensing electrode senses that non-conductive liquid flows into the sensing chamber via the sensing capacitance change.

According to the invention, the quantitative working fluid is used as the medium for inertia detection. With the change of the width and the depth of the channel and the connection open angle, when the working fluid flows due to the inertia force, the sensing electrodes can receive the signal to actuate the inertia switch via the change of the resistance or the capacitance. Furthermore, the time delay function can be obtained and various by changing the width and the depth of the channel and the connection open angle when the liquid material flows under an inertia force. Consequently, the performance and the application range of the inertia switch are improved.

The base plate may be made of Si-substrate, and the cover plate may be made of glass substrate, which is not limited herein. For example, the base plate is made of a glass substrate and the cover plate is made of a Si-substrate is also in the scope of the invention.

In contrast with a conventional mechanical and assembly structure with many components such as gears, slide blocks, springs, the liquid material is used as the medium for inertia detection in the invention, it can overcome disadvantages of large volume, heavy, a huge amount of manpower and time, many equipment and high cost.

Moreover, the time delay function can be improved greatly. The preliminary test shows that the time delay is more than 10 seconds, and the performance of the switch is improved greatly, and then the inertia switch can be used more widely, so as to improve the characteristic and the yield, and the switch is more competitive.

Additionally, the liquid material is integrated to the structure of the inertia switch, by changing the width of the channel, the depth, the connection open angle, and the kind of the working fluid, the material characteristics are changed, such as the surface tension and the solid liquid contact angle, and then the flow resistance effect is changed, and the time delay range is improved greatly and can be adjusted according to the specification. In sum up, the product, the process and the material are involved in the invention.

DETAILED DESCRIPTION OF THE EMBODIMENTS

Figure 1:
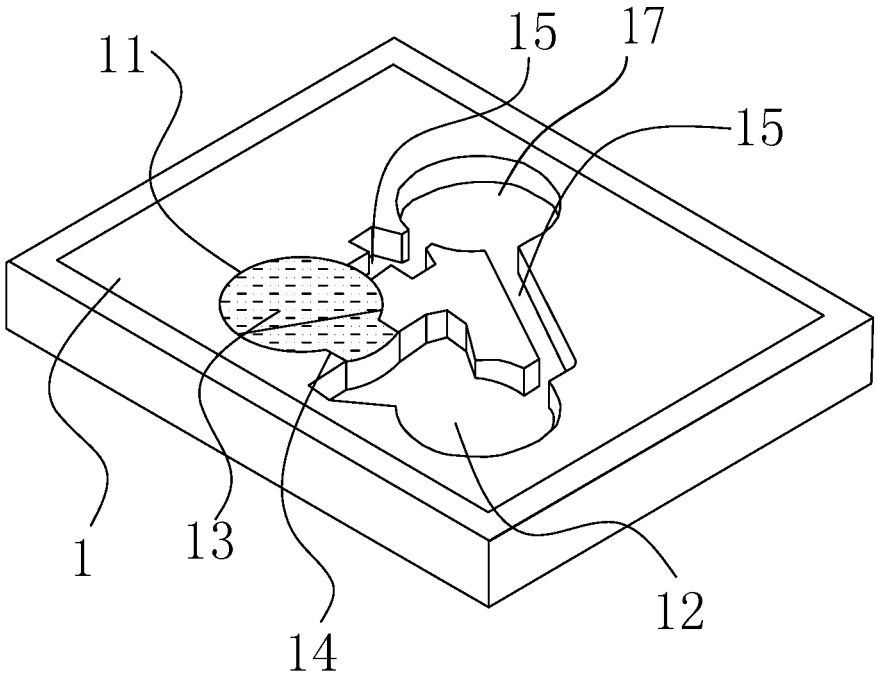
FIG. 1 is a schematic diagram showing a base plate of an inertia switch according to an embodiment of the invention.

These and other features, aspects, and advantages of the invention will become better understood with regard to the following description, appended claims, and accompanying drawings.

As shown in FIG. 1 to FIG. 6, in an embodiment, an inertia switch includes a base plate 1 and a cover plate 2 overlaid together. The base plate 1 includes a liquid storage chamber 11 and sensing chamber 12 communicating with each other, and working fluid 13 is sealed in the liquid storage chamber 11. The sensing chamber 12 includes a sensing electrode 21 extending to connecting equipment outside the inertia switch.

The base plate 1 may be made of Si-substrate, and the cover plate 2 may be made of glass substrate.

FIG. 1 is a schematic diagram showing a base plate 1 of an inertia switch according to an embodiment of the invention. The base plate 1 includes a liquid storage chamber 11 and a sensing chamber 12 which are connected via a channel 14. The working fluid 13 in the liquid storage chamber 11 may be liquid metal such as Galinstan, mercury or Na—K alloy, and it also may be a nonmetal liquid, and the non-conductive liquid may be Glycerin, water, polyethylene glycol or SDS, which is not limited herein. The liquid storage chamber 11 and the sensing chamber 12 may be connected to a pressure regulation chamber 17 via two air channels 15, respectively. The pressure regulation chamber 17 regulates the pressure at the liquid storage chamber 11 and the sensing chamber 12, so as to avoid that the working fluid 13 is blocked due to the pressure difference in the flowing. The shape and the structure of each air channel 15 is not limited herein, which can be various according to practical requirements. The air channel 15 of the liquid storage chamber 11 and the air channel 15 of the sensing chamber 12 may be connected as shown in FIG. 1.

Figure 2:
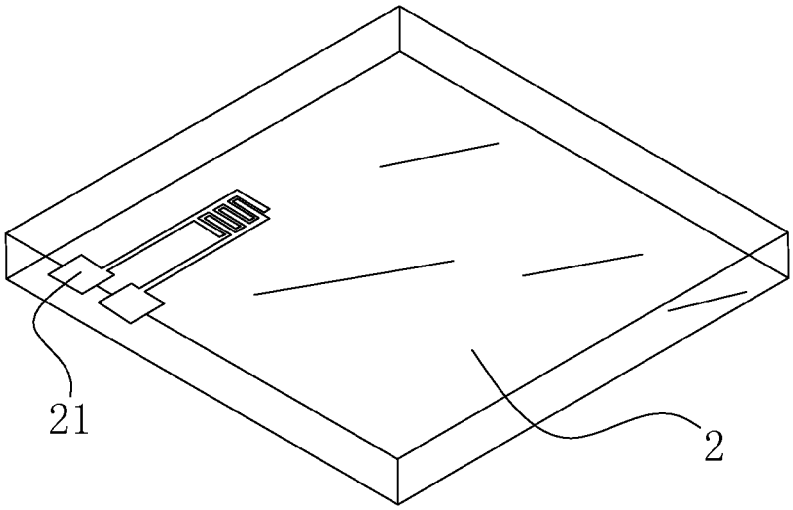
FIG. 2 is a schematic diagram showing a cover plate of an inertia switch according to an embodiment of the invention.

FIG. 2 is a schematic diagram showing the cover plate 2 of an inertia switch according to an embodiment of the invention. The cover plate 2 includes a sensing electrode 21 corresponding to the position of the sensing chamber 12. The shape and the structure of the sensing electrode 21 can be various according to practical requirements, which is omitted herein.

Figure 3:
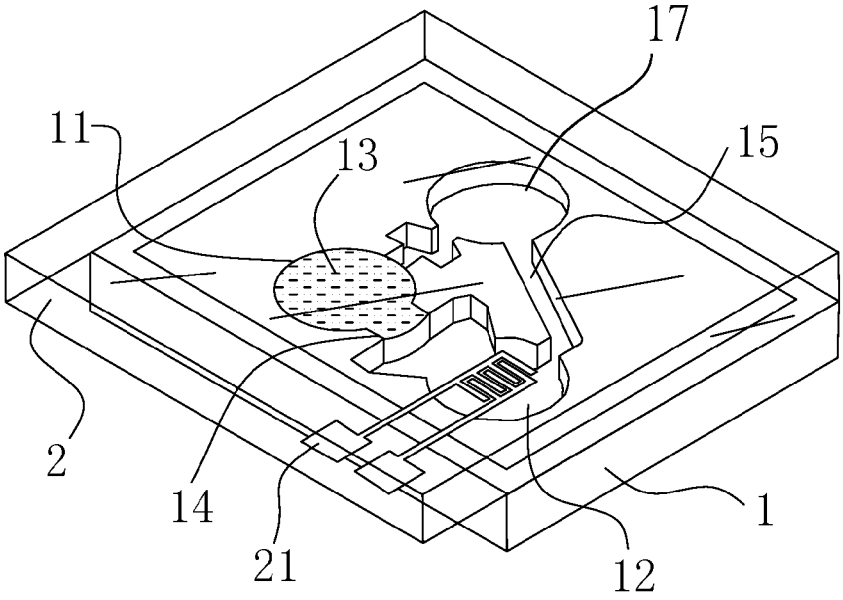
FIG. 3 is a schematic diagram showing an assembled inertia switch according to an embodiment of the invention.

FIG. 3 is a schematic diagram showing an assembled inertia switch according to an embodiment of the invention. After the Si-substrate base plate 1 and the cover plate 2 is combined, the sensing electrode 21 is in the sensing chamber 12, and the working fluid 13 is sealed in the liquid storage chamber 11.

Figure 4:
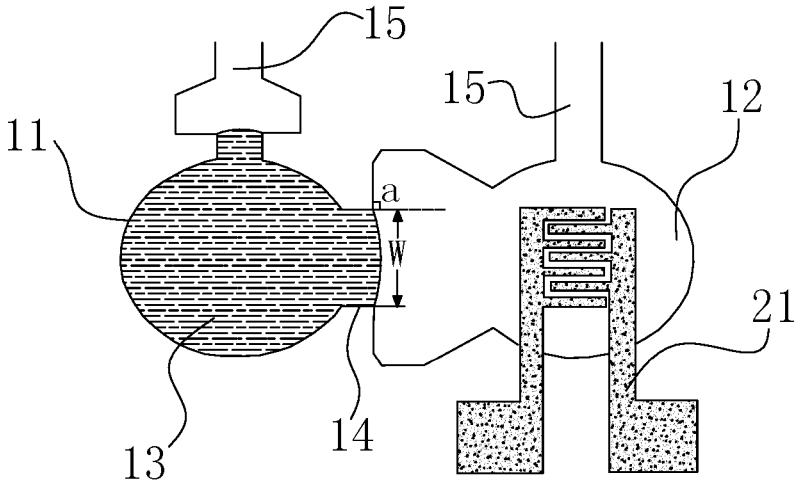
FIG. 4 is a plan showing the structure principle of an inertia switch according to an embodiment of the invention.

FIG. 4 is a plan showing the structure principle of an inertia switch according to an embodiment of the invention. When the condition for the actuation of the inertia switch is met, for example, the equipment installing with the inertia switch is hit by an inertia impact, the working fluid 13 overcomes the resistance and flows into the sensing chamber 12, the sensing electrode 21 senses that the working fluid 13 flows in via a resistance change or a capacitance change, and a sensing signal is sent out to actuate an external equipment that is connected to the inertia switch. If the inertia impact is not enough to make the working fluid 13 flow into the sensing chamber 12, the inertia switch would not be actuated. The value of critical resistance can be changed by adjusting the width of the channel W, the connection open angle a between the channel 14 and the sensing chamber 12, the type of the working fluid. The wider the channel 14, the smaller connection open angle a, and the smaller surface tension of the working fluid 13 can make the working fluid 13 more easily overcome the resistance to flow into the sensing chamber 12, and vice versa.

Figure 5:
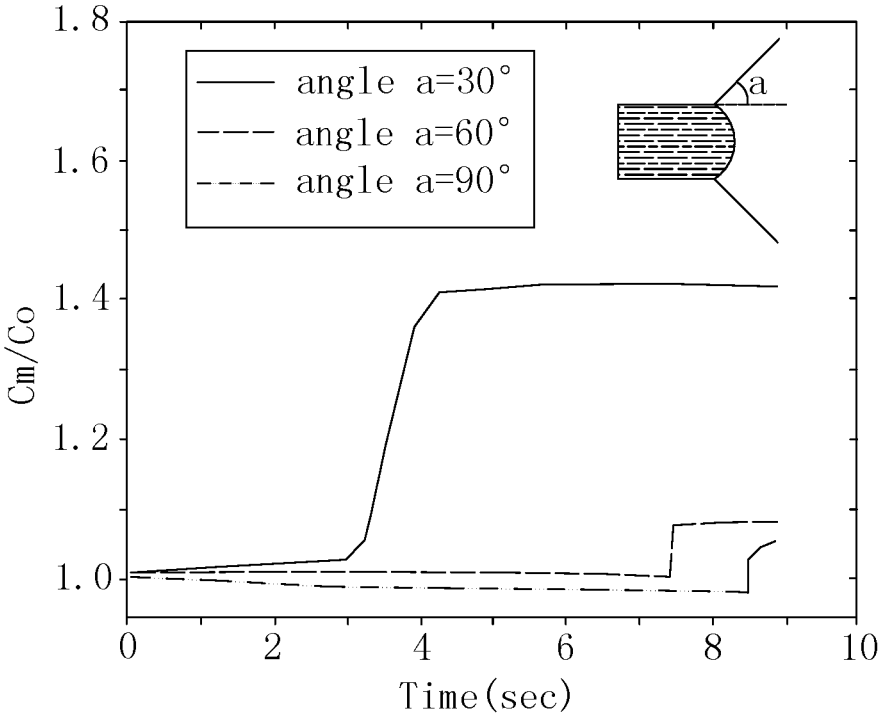
FIG. 5 is a schematic diagram showing the relationship between the connection open angle and the time delay of an inertia switch according to an embodiment of the invention.
Figure 6:
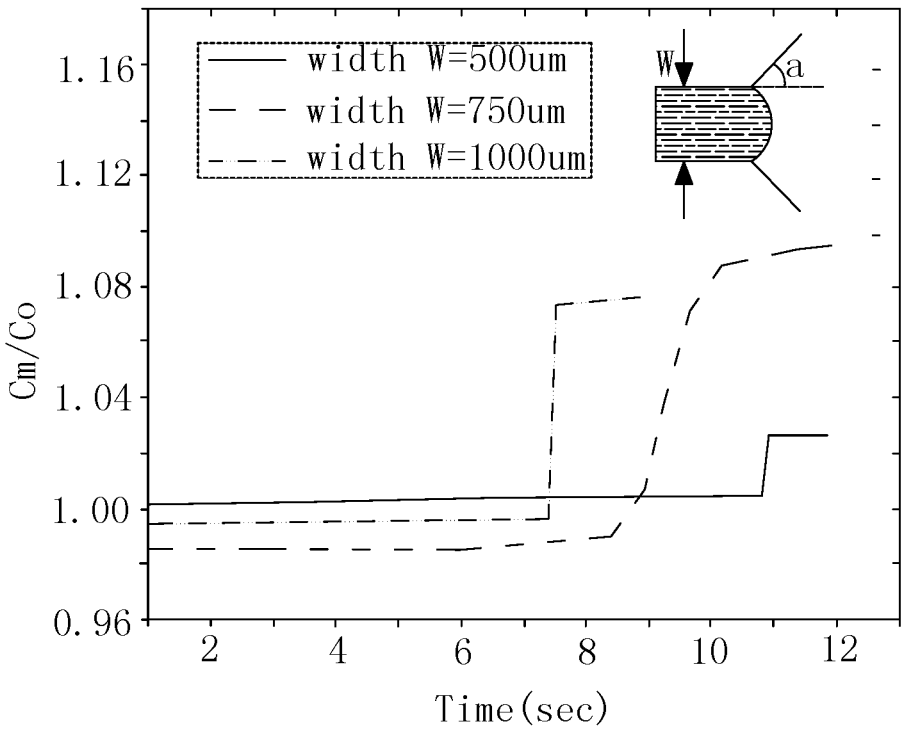
FIG. 6 is a schematic diagram showing the relationship between the width of the channel and the time delay of an inertia switch according to an embodiment of the invention.

Since it needs a certain period of time for the working fluid 13 flowing from the liquid storage chamber 11 to the sensing chamber 12, the delay-start problem of the switch also can be solved, and the delay time can be controlled by producers. The wider the channel 14, the smaller connection open angle a, and the smaller surface tension of the working fluid 13 can make the working fluid 13 flow more easily, and the time delay is shorter. FIG. 5 is a schematic diagram showing the relationship between the connection open angle and the time delay of an inertia switch according to an embodiment of the invention, it shows the change of the time delay when the connection open angle a is between 30 to 90 degrees. When the connection open angle a is 30 degrees, the time delay is 3 seconds; when the connection open angle a is 60 degrees, the time delay is more than 7 seconds; when the connection open angle a is 90 degrees, the time delay is more than 8 seconds. FIG. 6 is a schematic diagram showing the change of the time delay when the width of the channel W is between 500 to 1000 micrometers. When the width of the channel W is 500 micrometers, the time delay is about 11 seconds; when the width of the channel W is 750 micrometers, the time delay is about 9 seconds; when the width of the channel W is 1000 micrometers, the time delay is about 7 seconds. However, the width and the angle is not limited to the embodiments in FIG. 5 and FIG. 6, producers also can achieve the time delay in other ways.

The time delay, the criteria for starting resistance can be adjusted dynamically according to the invention, and the simple liquid flowing mechanism can replace conventional complicated structures of the inertia switch. The inertia switch in the embodiments of the invention can be widely applied at various occasions.

Figure 7:
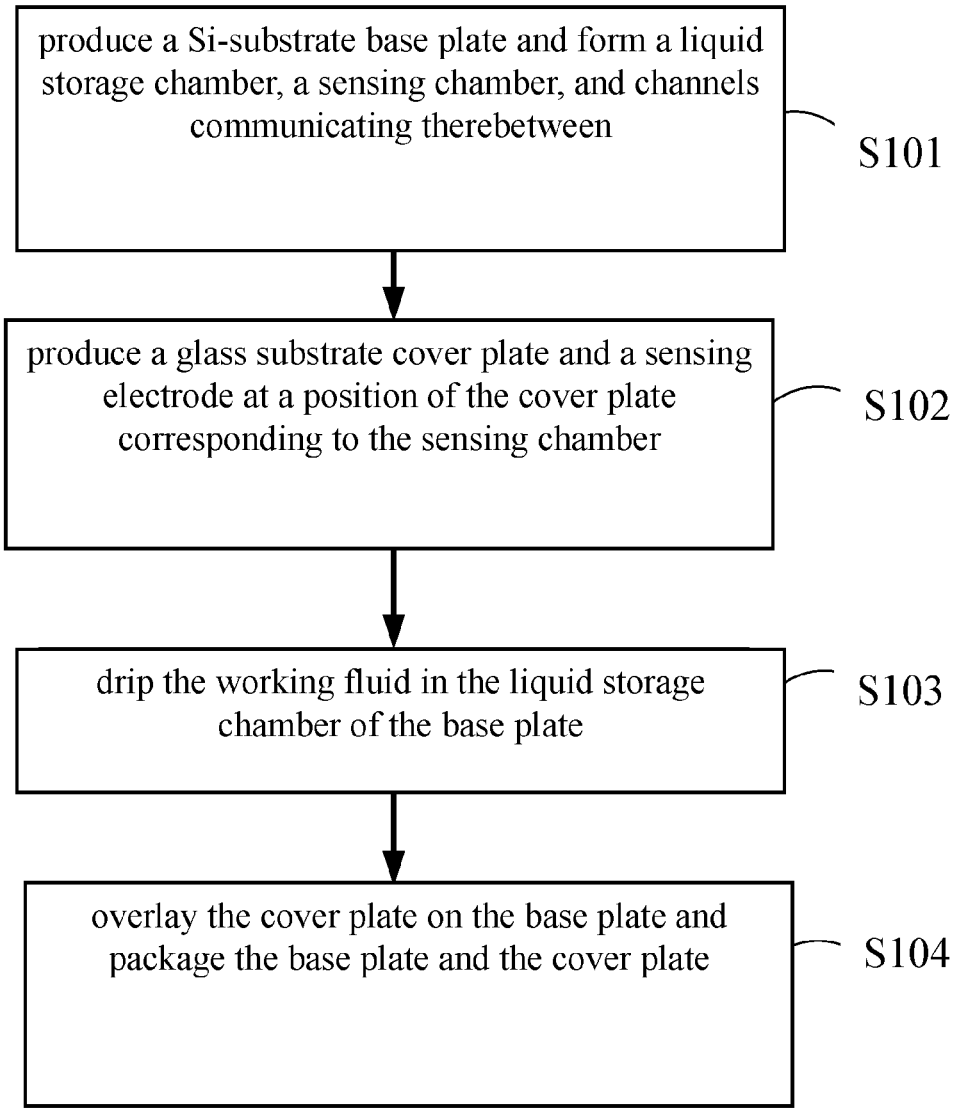
FIG. 7 is a flowchart showing a method for producing an inertia switch according to an embodiment of the invention.

As shown in FIG. 7, a method for producing the inertia switch in an embodiment of the invention includes the following steps.

In step S101, producing the base plate 1 and forming a liquid storage chamber, a sensing chamber, and channels communicating the liquid storage chamber and the sensing chamber at the base plate 1;

In step S102, producing the cover plate 2, and producing a sensing electrode 21 at a position of the cover plate 2 corresponding to the sensing chamber 12;

In step S103, dripping the working fluid 13 in the liquid storage chamber 11 of the base plate 1;

In step S104, overlaying the cover plate 2 on the base plate 1 and packaging the base plate 1 and the cover plate 2.

Furthermore, the above steps can be performed in many ways. For example, in step S101, the liquid storage chamber, the sensing chamber, and channels communicating therebetween are formed by the silicon wafer etching means in the micro-electromechanical process. In step S102, the sensing electrode 21 is produced by Physical Vapor Deposition (PVD) and photolithography process, a polymer zone is defined at the sensing electrode 21 via the polymer deposition system and the photolithography and Oxygen plasma etching, so as to obtain the hydrophilic metal electrode part and the hydrophobic polymer part, respectively. In step S103, a quantitative dispensing system is used to drip the working fluid 13 into the liquid storage chamber 11. In step S104, the base plate 1 and the cover plate 2 are packaged via the micro-electromechanical wafer bonding process.

Figure 8:
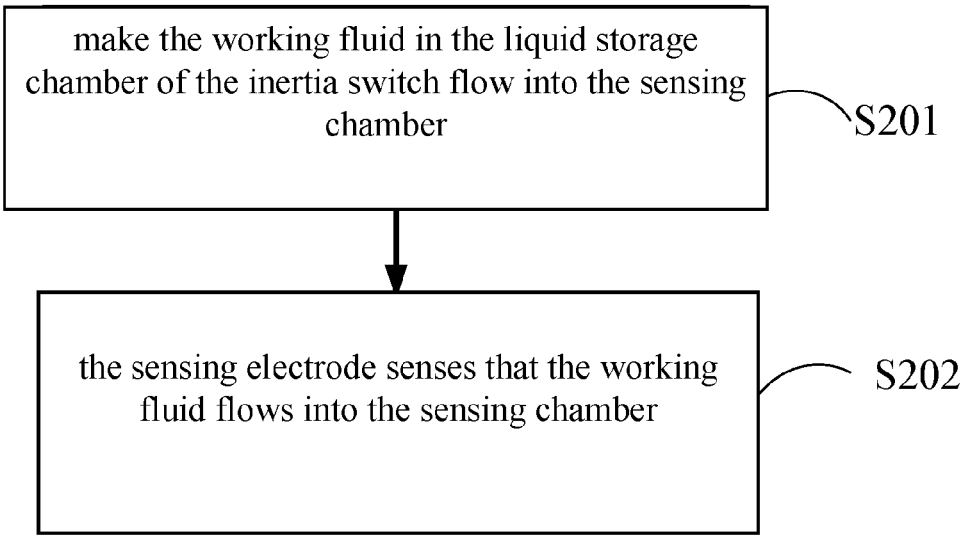
FIG. 8 is a flowchart showing actuation method of an inertia switch according to an embodiment of the invention.

FIG. 8 is a flowchart showing actuation method of an inertia switch according to an embodiment of the invention.

In step S201, making the working fluid 13 in the liquid storage chamber 11 of the inertia switch flow into the sensing chamber 12;

In step S202, the sensing electrode 21 senses that the working fluid 13 flows into the sensing chamber 12.

The sensing signal can actuate an external equipment connected to the inertia switch.

The working fluid 13 is preferably a liquid metal. The sensing electrode 21 senses that the working fluid flows into the sensing chamber 12 via a resistance change or a capacitance change. The liquid metal is preferably Galinstan, mercury, or Na—K alloy. The working fluid 13 may be a non-metal liquid such as Glycerin, water, polyethylene glycol or SDS. The sensing electrode 21 senses that the working fluid flows into the sensing chamber 12 via the sensing the capacitance change.

In the embodiments of the invention, the inertia switch utilizes the time delay function and the inertia detection function of working fluid. Furthermore, the channels of the base plate, the liquid storage chamber, and the sensing chamber is formed via the silicon wafer etching means, the sensing metal electrodes and wires are produced at the cover plate via the PVD and the photolithography process, and then the polymer zone is defined via the polymer deposition system and the photolithography and Oxygen plasma etching means, so as to obtain a hydrophilic zone (the metal electrode part) and a hydrophobic zone (the polymer part), respectively, the quantitative dispensing system is used to drip the liquid material (such as Galinstan, mercury, Na—K alloy, Glycerin, water, polyethylene glycol, or SDS) to the liquid storage chamber. Then, the base plate and the cover plate are packaged via the micro-electromechanical wafer bonding process to integrate the time delay function of the working fluid and the inertia detection function.

According to the principle of the invention, the quantitative working fluid is used as the medium for inertia detection, when the working fluid flows due to the inertia force, the time delay function can be obtained and various by changing the width and the depth of the channel and the connection open angle. When the liquid flows into the sensing chamber after the time delay, the sensing electrodes can receive the signal via the change of the resistance or the capacitance to actuate the inertia switch.

Although the invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An inertia switch, comprising a base plate and a cover plate overlaid on the base plate, wherein the base plate includes a liquid storage chamber, a sensing chamber, and a channel communicating between the liquid storage chamber and the sensing chamber, a working fluid is stored in the liquid storage chamber, and a sensing electrode has a main portion directly above the sensing chamber and has an extending portion extending outside the inertia switch, wherein the cover plate has a main portion that is directly above the base plate and has an extending portion that is not directly above the base plate, the main portion of the sensing electrode is located directly below and in contact with the main portion of the cover plate, and the extending portion of the sensing electrode is located directly below and in contact with the extending portion of the cover plate, such that the extending portion of the sensing electrode is not directly above the base plate and not directly above the sensing chamber.

2. The inertia switch according to claim 1, wherein the width of the channel is between 500 to 1000 micrometers.

3. The inertia switch according to claim 2, wherein the width of the channel is 750 micrometers, and the depth of the channel is 250 micrometers.

4. The inertia switch according to claim 1, wherein a connection open angle between the channel and the sensing chamber is 30 to 90 degrees.

5. The inertia switch according to claim 4, wherein the connection open angle between the channel and the sensing chamber is 60 degrees.

6. The inertia switch according to claim 1, wherein the liquid storage chamber and the sensing chamber are connected to a pressure regulation chamber via at least two air channels, respectively.

7. The inertia switch according to claim 1, wherein the working fluid is a liquid metal.

8. The inertia switch according to claim 7, wherein the liquid metal is Ga—In—Sn alloy, mercury, or Na—K alloy.

9. The inertia switch according to claim 1, wherein the working fluid is a non-conductive liquid, and the non-conductive fluid is Glycerin, water, polyethylene glycol, or sodium dodecyl sulfate (SDS).

* * * * *